United States Patent [19]

Hanaya

[11] 4,232,720

[45] Nov. 11, 1980

[54] ROUND LOG MATERIAL AND METHOD OF PRODUCING THE SAME

[75] Inventor: Morimasa Hanaya, Kure, Japan

[73] Assignee: Toyo Pulp Co., Limited, Tokyo, Japan

[21] Appl. No.: 743,378

[22] Filed: Nov. 19, 1976

Related U.S. Application Data

[63] Continuation of Ser. No. 487,508, Jul. 11, 1974, abandoned.

[30] Foreign Application Priority Data

Aug. 4, 1973 [JP] Japan ..... 48-87848

[51] Int. Cl.[3] ..... A01G 23/08

[52] U.S. Cl. ..... 144/309 AC; 144/3 D; 144/326 R

[58] Field of Search ..... 114/312, 3 D, 309 AC, 114/326 R; 114/27; 214/700, 12

[56] References Cited

U.S. PATENT DOCUMENTS

| | | | |
|---|---|---|---|
| 2,727,542 | 12/1955 | Fischer | 144/326 A |
| 3,500,882 | 3/1970 | Tanguay | 144/3 D |
| 3,540,399 | 11/1970 | Gabrielsson | 114/27 |
| 3,556,319 | 1/1971 | Holden | 214/12 |
| 3,650,307 | 3/1972 | Johnson | 144/3 R |
| 3,757,724 | 9/1973 | Lunde | 114/27 |

*Primary Examiner*—W. Donald Bray
*Attorney, Agent, or Firm*—Ladas & Parry

[57] ABSTRACT

Round log material is provided in transversely cut log portions suitable for simplified bulk loading, transporting, unloading, storing and utilization as compared with prior bulk handling operations.

13 Claims, 2 Drawing Figures

ROUND LOG MATERIAL AND METHOD OF PRODUCING THE SAME

Figure 1:
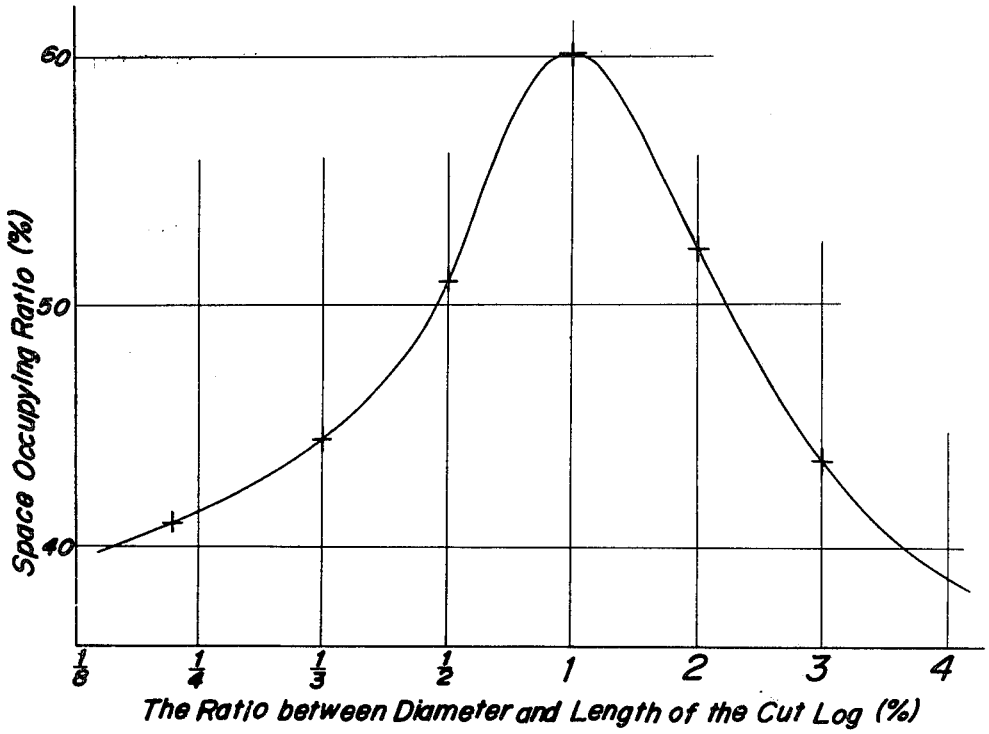

This is a continuation of application Ser. No. 487,508 filed July 11, 1974 and now abandoned.

This invention relates to round log material and a method of producing the same in a form suitable for simplified bulk loading, transporting, unloading, storing and utilization as compared with prior bulk handling operations.

Enormous wood resources are required for manufacturing wood pulp, hard board, particle board, wood wool cement board and the like. The transportation of whole round logs involves many problems such as space-wasting loading due to differing loglengths, inefficient loading and unloading techniques for bundles or logs, unnecessary manual labor, etc., all of which result in high costs. Therefore logs have often been chipped prior to transportation, except where the logs are intended for structural elements such as lumber and plywood. However the chip volume is three times greater than the log volume, and the space occupying ratio of the chips only ranges from 28 to 34%, although this ratio can be improved to about 40% by using vibration or high speed blowing. Therefore in spite of reduction in expense due to improving cargo handling efficiency, the cost of chip transportation per unit weight is still extremely high when compared with ore, coal or grain having higher specific gravity.

The transportation of wood chips to consumer countries such as Japan in ships exclusively designed for this purpose was originally intended for chips obtained from waste logs in large saw mills in developed countries such as the United States and Canada. Since then, due to a shortage of wood resources, especially hard wood used for printing paper, small diameter log material obtained from mangrove, rubber, eucalyptus trees, etc., have also been transported in the form of wood chips from Southeast Asian countries, Australia and Brazil, and ships of over 20,000 tons for this purpose now number up to fifty.

However, transportation of wood chips from small diameter log material (e.g. 20–30 cm in diameter) from these countries has still involved many problems, such as expense resulting from low space occupying ratio, damages to the chips caused by high speed blowing, pollution caused by chip dust in storage, deterioration due to oxidation, leakage of phenol and other water-soluble harmful substances resulting from rain, offensive odors, and fire danger from lengthy storage of the chips.

An object of the present invention is to overcome these problems and provide improved bulk handling of round log material together with improved space occupying ratio.

In accordance with the invention round log material is provided in a form suitable for simplified bulk loading, transporting, unloading, storing and utilization, said material comprising a plurality of log portions which have been transversely cut in such manner that each portion has a length from one fourth to four times its diameter.

SUMMARY OF THE INVENTION

Such cut log material can be handled by conventional cargo handling machinery such as belt conveyors, crab bucket cranes, bulldozers, etc., and can be transported in conventional ships with remarkably reduced freight charges in conjunction with high space occupying ratio rating 50–60 percent. Another advantage of the invention is that the cut log material can be stored as is and as much as required can be used daily, thus removing various difficulties mentioned above. Further advantage of the invention is that the cut log can be stored in the sea, so that it can be obtainable easily even by a mill located inland, where big ships are not available, whereas wood chips cannot be stored in like manner, as they scatter and disperse in the water.

In an attempt to seek the best ratio between the diameter and the length of a cut log experiments have been made which are described as follows:

A steel box of a rectangular prism 5 m long, 5 m wide and 5 m high, with a cubic capacity of 125 m, was installed underneath and at the end of a belt conveyor, the center of bed pulley of which is positioned at 8 m height from the ground surface.

Then a round log, diameter of which was approximately 20 cm, was cut to short length, so that they form seven different groups having different ratio of the diameter to the length, namely 25% (20 cm×80 cm), 33.3% (20 cm×60 cm), 50% (20 cm×40 cm), 100% (20 cm×20 cm), 200% (20 cm×10 cm), 300% (20 cm×6.7 cm) and 500% (20 cm×4 cm) respectively. The cut logs of each different groups were then throwed into the steel box by the belt conveyor until the steel box is filled. The number of the cut logs of each different group was counted up to determine solid volume and was divided by 125 (unit cubic capacity of the steel box) to calculate the space occupying ratio. Given below is a table indicating the result of the experiments.

| The ratio between the diameter and the length | Space occupying ratio |
|---|---|
| 1 : 1 | 60.2% |
| 1 : 2 | 52.4% |
| 1 : 3 | 43.7% |
| 1 : 4 | 38.8% |
| ½ : 1 | 50.9% |
| ⅓ : 1 | 44.3% |
| 1/5 : 1 | 40.8% |

All who undertook the experiments were surprised to find out the fact that the best result was obtainable by cutting the log at the ratio of 1:1.

When cutting the log to short length, it is technically difficult to take measure all of the diameter of individual parts to be cut in order to ascertain correct ratio between the diameter and the length, because diameters differ from the top end to bottom end. Therefore the cutting ratio of 1:1 needs not necessarily be absolutely exact.

Experiments have also shown that, when cutting the log to short length, it is better and preferable to cut it a little longer in order to avoid overturn of the cut log on the belt conveyor.

Figure 2:
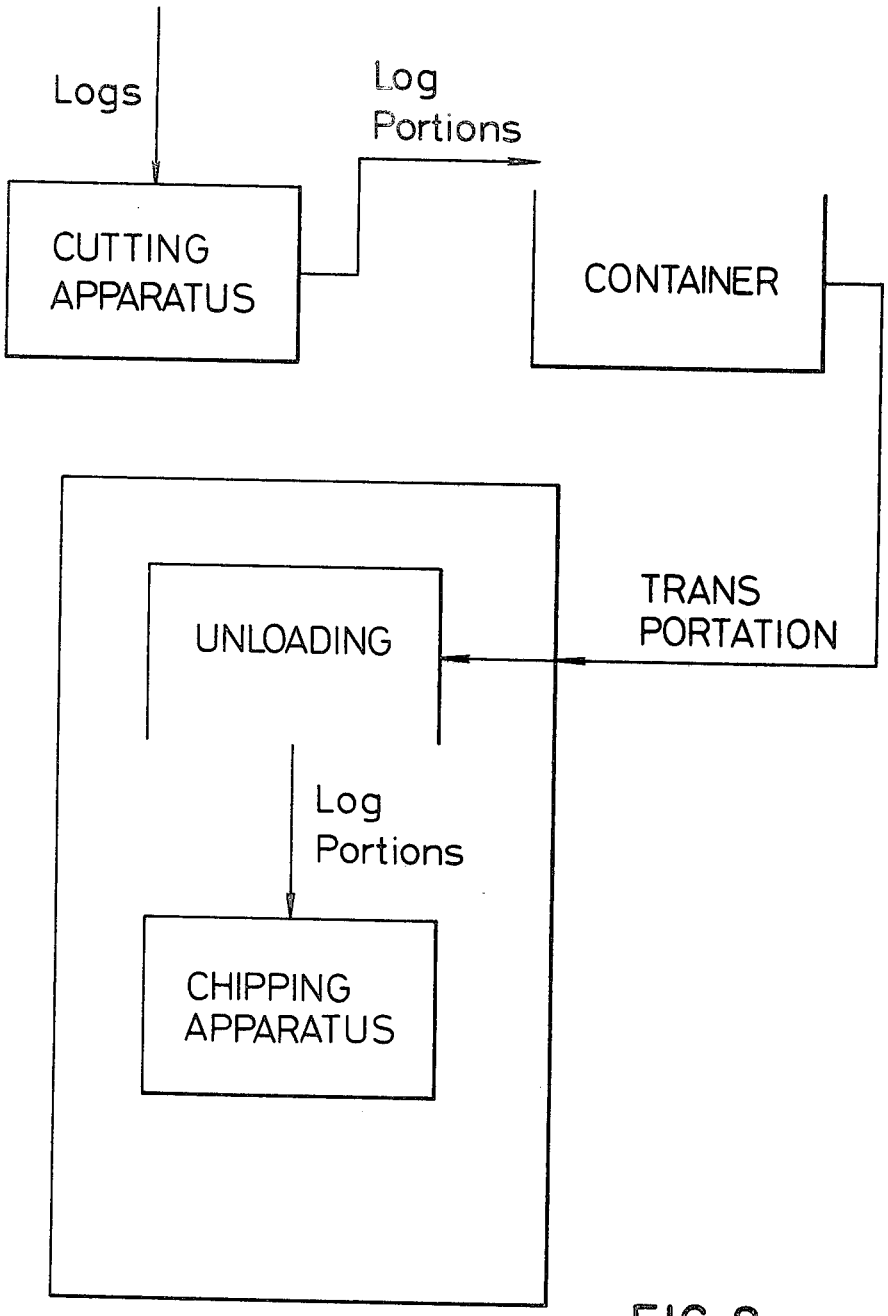

In order that the invention can be fully understood it will now be described with reference to the accompanying drawing, which FIG. 1 is a graphical representation illustrating the relationship between the space occupying ratio and the ratio of the diameter to the length of a cut log and FIG. 2 is a flow diagram.

Through experiments the best ratio between the diameter and the length of a cut log has been sought and the result of such experiments is indicated in the graphical representation of the drawing, wherein the ratio of the diameter of the cut log to the length thereof is represented by the abscissae and the space occupying ratio by the ordinates. As is apparent from this graphical representation, the space occupying ratio of the cut log portions is a maximum i.e. 60 percent, when the length of the log is equal to its diameter. On the other hand, the space occupying ratio is only 42 percent when said ratio is one fourth, and 39 percent when said ratio is four times. Comparing the freight expense of the cut log portions of the invention with that of wood chips, since 1.5 times as much of the former can be loaded as of the latter, even when the latter is loaded to a maximum 40 percent space occupying ratio by means of special loading, the freight expense per unit weight of the former will be two thirds of the latter, assuming that the cargo handling efficiency is same.

The high space occupying ratio will not only reduce transportation costs but also will increase the efficiency of belt conveyors and cranes, which will again reduce stevedoring charges leading to further reduction of transportation costs. Conventionally, the length of transported logs has been 10–20 times of their diameter. It was therefore necessary to load the logs as bundles extending in the same direction in order to avoid dead space: For this reason transportation costs were much higher.

FIG. 2 illustrates the operations performed on the logs. The logs are first cut into suitable length portions, so that the length of each portion is about equal to its diameter, and the log portions are then loaded into a transport container. The container is transported to an unloading point at which the log portions are unloaded from the container and are chipped in chipping apparatus.

Typical operations according to the present invention in cutting logs to short length are as follows:

1. Cutting to short length by means of chain saws utilizing abundant manpower.

In developing countries, where wages are low and employment of local labor is compulsory, the logs are cut to suitable lengths, preferably about equal to the log diameter but within the range of one fourth to four times the diameter utilizing the abundant manpower.

2. Cutting to short length by means of a circular saw installed in barges.

In the case of mangrove or other trees growing on the coast, the logs are loaded on barges and cut at sea by means of circular saws or other cutters installed in the barges.

3. Cutting to short length by means of multiple saws.

The logs are cut to desired length by means of circular saws or band saws installed on a chain conveyor at suitable intervals from both ends, then remaining center part is held by means of a holding system and is cut at the center thereof. This will dispense with much labor.

Typical operations according to the present invention in loading the cut log portions are as follows:

1. Loading by means of a belt conveyor.

The cut logs are loaded utilizing existing belt conveyors for ore. A belt trimmer may be used at the inside of the hatch coaming of the ship, although it usually is not necessary to do so, because the cut logs skip around to a considerable distance due to the shock of falling and do not occupy a large dead space. A chain conveyor can also be used for this purpose.

2. Loading by means of a bucket crane.

The cut logs are loaded utilizing an orange-peel type of bucket crane.

3. Loading by means of running water.

The cut logs may be loaded by utilizing circulating running water, except those having heavier specific gravity.

Typical operations according to the present invention in unloading the cut logs are as follows:

1. Unloading by means of a bucket crane.

The cut logs are unloaded by means of an orange-peel type bucket crane.

2. Unloading by means of running water.

The cut logs are unloaded by means of circulating running water, except those having heavier specific gravity.

3. Unloading by means of a dumper.

One of the bottom side tanks of the ship under the cargo hold is filled by water, so that the ship lists to port or starboard and the cut logs are dumped into the water. This method is suitable for a barge type ship.

Typical operations according to the present invention in storing the cut logs are as follows:

1. Storing by means of a belt conveyor.

The cut logs are transported to the storage yard by means of a bolt or chain conveyor, then dropped down into yard for storing.

2. Storing by means of running water.

The cut logs are transported to the storage yard by means of running water, then dropped down into the yard for storing. The water is recovered for further use.

3. Storing on the surface of the sea.

In the case of a factory located inland, the cut logs are dumped onto the surface of the sea from a ship exclusively designed for that purpose, then stored as is. The cut logs scattered on the surface of the sea are then collected by means of a dozer installed on a pusher barge and brought into a log pond.

Typical operations according to the present invention in utilizing the cut logs are as follows:

1. Utilization for chips.

The cut logs are processed by a special chipper equipped with a feeding system, which enables the cut logs to be chipped parallel to grain direction, as chipping by means of a conventional chipper may be difficult because of the short length.

2. Utilization for wood wool.

The cut logs are shaved into wood wool by means of a shaving machine for wood wool or wood wool cement board.

3. Utilization for ground wood pulp.

The cut logs are ground by means of a stone type grinder and manufactured into ground wood pulp.

4. Utilization for particle board.

The cut logs are shaved by a shaving machine for particle board.

What is claimed is:

1. A method of bulk loading and transporting timber, which includes cutting felled timber transversely into a plurality of log portions, each portion having a length substantially equal to its diameter, mechanically loading said log portions into a transport container at random, transporting the container to an unloading point at which the log portions are unloaded from the transport container, and chipping the log portions.

2. A method as claimed in claim 1, wherein said timber is cut into said portions by means of chain saws.

3. A method as claimed in claim 1, wherein said timber is cut into said portions by means of multiple saws.

4. A method as claimed in claim 1, wherein said timber is cut into said portions by means of multiple saws from both ends, whereafter the remaining central part is held by means of a holding system and is cut at the center thereof.

5. A method as claimed in claim 1, wherein the transport container is part of a transport vehicle.

6. A method as claimed in claim 5, wherein said vehicle is a ship.

7. A method as claimed in claim 5, wherein said log portions are loaded by means of a belt or chain conveyor.

8. A method as claimed in claim 5, wherein said log portions are loaded by means of a bucket crane.

9. A method as claimed in claim 6, wherein said log portions are floated into the hold of the ship in a stream of running water which is subsequently pumped out.

10. A method as claimed in claim 5, wherein the log portions are unloaded by means of a bucket crane.

11. A method as claimed in claim 6, wherein the log portions are unloaded by causing the ship to list so that the log portions are dumped into the water.

12. A method of bulk loading and transporting timber, which includes cutting felled timber transversely into a plurality of log portions, each portion having a diameter from substantially 20 cm. to substantially 30 cm. and a length substantially equal to its diameter, mechanically loading said log portions into a transport container at random, transporting the container to an unloading point at which the log portions are unloaded from the transport container, and chipping the log portions.

13. A method as claimed in claim 12, wherein each log portion is substantially 20 cm. in diameter.

* * * * *